United States Patent [19]

Nilson

[11] 4,249,675

[45] Feb. 10, 1981

[54] DEVICE FOR DISPENSING FLUID FROM A CONTAINER

[75] Inventor: Billy N. Nilson, Mjolby, Sweden

[73] Assignee: KeNova AB, Malmo, Sweden

[21] Appl. No.: 20,666

[22] Filed: Mar. 15, 1979

[30] Foreign Application Priority Data

Mar. 15, 1978 [SE] Sweden ..... 7803290

[51] Int. Cl.[3] ..... B65D 37/00

[52] U.S. Cl. ..... 222/207; 222/209; 222/210; 222/212; 222/494

[58] Field of Search ..... 222/51, 59, 62, 67, 222/207, 209, 210, 212, 213, 441, 425, 448–450, 475, 492, 494, 495, 498

[56] References Cited

U.S. PATENT DOCUMENTS

| | | | |
|---|---|---|---|
| 916,131 | 3/1909 | Evans | 222/62 |
| 1,449,238 | 3/1923 | Miller | 222/207 |
| 2,943,767 | 7/1960 | Morolin | 222/207 |
| 2,970,722 | 2/1961 | Levenson | 222/62 |
| 3,160,329 | 12/1964 | Radic | 222/207 |
| 3,229,854 | 1/1966 | Turnquist | 222/450 |
| 3,828,985 | 8/1974 | Schindler | 222/207 |
| 4,085,867 | 4/1978 | Heller | 222/207 |

FOREIGN PATENT DOCUMENTS

| | | |
|---|---|---|
| 171520 | 5/1960 | Sweden . |
| 592339 | 10/1977 | Switzerland . |

*Primary Examiner*—H. Grant Skaggs
*Attorney, Agent, or Firm*—Finnegan, Henderson, Farabow, Garrett & Dunner

[57] ABSTRACT

A device for dispensing fluid from a container has a tubular and flexible metering chamber, intended to be squeezed by a hand. The metering chamber is closed by means of a self-closing closure, which however opens in response to a predetermined pressure upon the fluid. A floating body housed in said metering chamber limits the squeezing of the metering chamber and breaks, when floating in a sufficient amount of fluid in the metering chamber, the communication between the container and said metering chamber.

8 Claims, 2 Drawing Figures

DEVICE FOR DISPENSING FLUID FROM A CONTAINER

BACKGROUND OF THE INVENTION

Field of the Invention

This invention relates to a device for dispensing fluid from a container and more particularly to a device, comprising a metering chamber having a yieldable wall to be manually operated for dispensing of fluid from the container.

Such devices are well-known in the art. Continuing efforts have been made to develop such devices which are inexpensive to manufacture and easy to operate and which permit the dispensing also of relatively big amounts and in which the amount varies with the size of the hand operating the yieldable wall and the force with which said wall is squeezed.

BRIEF SUMMARY OF THE INVENTION

It is therefore the primary object of this invention to improve devices for dispensing fluid from a container having a metering chamber with a yieldable wall.

It is another object of this invention to provide improved devices for dispensing fluid from a container having a metering chamber with a yieldable wall and a floating body housed in said metering chamber to seal off the container from the metering chamber during the dispensing operation and to limit the squeezing of said yieldable wall.

It is a further object of this invention to reduce the cost and improve the closing security of the device for dispensing flowable material upon the application of pressure of said yieldable wall of the device.

Additional objects of this invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the foregoing objects and in accordance with the purpose of the invention, as embodied and broadly described herein, the device of this invention comprises a metering chamber having a yieldable wall, the interior of said metering chamber communicating with the interior of said container by means of an opening through which fluid from said container can flow into said metering chamber, said metering chamber having an outlet opening being closed by means of a self-closing closure capable of opening in response to a predetermined pressure upon the fluid in said metering chamber, a floating body being housed in said metering chamber, said floating body, when floating in a sufficient amount of fluid in said metering chamber, having a portion thereof in sealing contact with a valve seat located between said container and said metering chamber to thereby break, in this position of said floating body, the communication between said container and said metering chamber but to open such a communication when the level of the fluid in said metering chamber is below a predetermined level.

BRIEF DESCRIPTION OF THE DRAWINGS

The accompanying drawings, which are incorporated in and constitute a part of this specification illustrate one embodiment of the invention and, together with a description, serve to explain the principles of the invention. Of the drawing.

DETAILED DESCRIPTION OF THE PREFERRED EMBODIMENT

Figure 1:
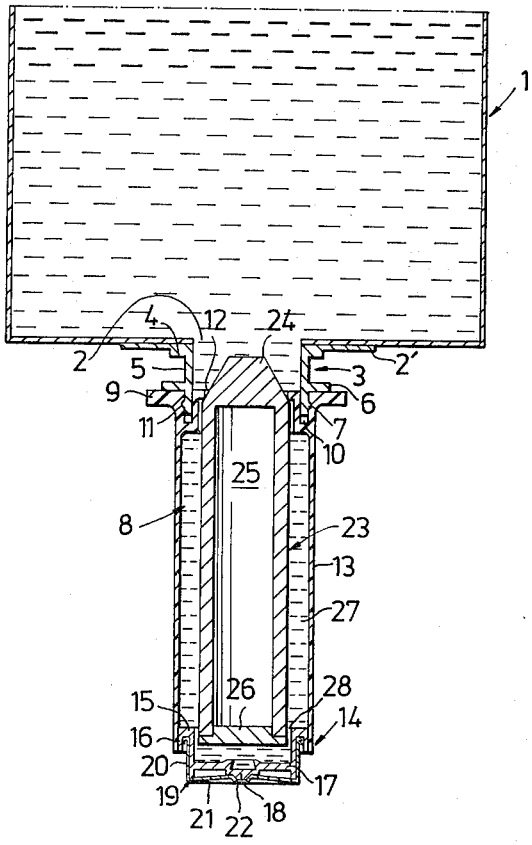
FIG. 1 is a sectional view through a preferred embodiment of the invention.

Reference will now be made in detail to the preferred embodiment of the invention, an example of which is illustrated in the accompanying drawing.

It should be noted that the term fluid means every movable medium, which may accomplish the function to be described in connection with the device to be described or similar devices. Obviously, the device may be applied to fluids of widely varying viscosities.

In the drawing reference numeral 1 designates a container which, as mentioned, may consist of a plastic bag that after having been filled may be closed, such as by folding the upper portion of the bag, and which may thus be used several times. The container or bag 1 has an outlet opening 2 in the lower portion thereof, according to FIG. 1 A portion 2' of an adapter having the general designation 3 is connected to the wall portion surrounding the outlet opening 2.

In the embodiment shown the adapter has an upper flange 4, a tubular portion 5 projecting downwardly therefrom and having a second flange 6 located intermediate the ends of said tubular portion as seen in FIG. 1. The tubular portion 5 has a circumferential bead 7 in the lower end thereof, for a purpose to be disclosed.

Reference numeral 8 generally designates a metering chamber preferably made from a resilient plastic material having a thickened portion in the upper portion thereof and defining an upper flange 9. An annular, relatively deep groove 10 is made in the upper end surface thereof and a circumferential groove 11 is made in one of the walls surrounding said groove 10. The groove 11 has substantially the same profile as the bead 7 of the adapter. Further, the flange has a central through opening 12.

A tubular, thin-walled portion 13 projects downwardly from the thickened portion or flange 9 and the lower open end thereof is connected to a self-closing closure 14.

The self-closing closure, known per se, comprises two members connected to each other along the outer edge portions thereof and one of said members has a relatively rigid, annular portion 15, to be fixedly and sealingly secured to the tubular portion 13 for instance by means of a plastic welding process. The portion 15 is integrally made with a central, axially projecting pin 18 by means of number of radial spokes 17 or a perforated portion. The second member of the closure is designated by numeral 19 and has a portion 20 surrounding the annular portion 15 and preferably secured to the annular portion 15 or some portion attached thereto and a thin walled portion 21 serving as a diaphragm projects therefrom and has a central outlet opening 22. As seen in FIG. 1 the diaphragm 21 normally inclines somewhat inwardly and is biassed so that it is resiliently pressed against the pin 18 which thereby sealingly closes the outlet opening 22.

A floating body generally designated by 23 is freely movable in a vertical direction of the metering chamber 8 defined by the tubular portion 13, flange 9, and the closure 14. In the embodiment shown said floating body comprises a cylindrical body conically shaped 24 in the upper end thereof to define a valve cone and which is hollow by a bore or a recess 25 and closed by a plug 26. The floating body 23 is made from a relatively rigid material, for a purpose to be disclosed. The diameter thereof is somewhat less than the inner diameter of the tube 13, so that an annular space 27 is defined between the tube 13 and the floating body. Also, an annular space 28 is defined between the lower portion of the floating body 23 and the self-closing closure, whereby it is ensured that the interior of the self-closing closure communicates with the interior of the tubular portion 13.

As may be seen in FIG. 1, the adapter serves to releasably connect the portion of the device forming the metering chamber 8 to the container. By making the metering chamber from an elastically yieldable material it is understood, that the portion of the tubular member of the adapter located below the flange 6, may be pressed into the groove 10 and that a durable and sealed connection is obtained when the bead 7 snaps into the groove 11. This occurs when the flange 6 contacts said flange 9.

When the container and the metering chamber 8 are filled with fluid the floating body is held in sealing contact with the opening 12, serving as a valve seat, via the valve cone 24 due to the floating force thereof. Similarly, the self-closing closure is closed in the starting position according to FIG. 1.

If the user with one hand seizes the tubular portion 13 and squeezes the hand, the wall 13 will be deformed and the fluid in the metering chamber 8 will be exposed to a pressure which is capable of opening the self-closing closure 14. Thereby, an amount of fluid, proportional to the extent of squeezage made by the manual compression of wall 13, is pressed out through the outlet opening 22 of the self-closing closure 14.

Figure 2:
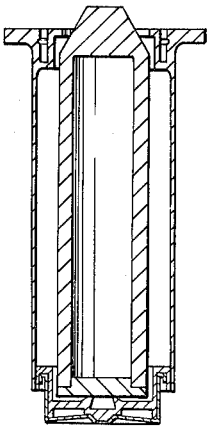
FIG. 2 is a corresponding sectional view of a floating body of the device in a non-operative position.

When the pressure is released, and the hand is removed from wall 13 said wall will return to the initial shape thereof, and the floating body moves towards the idle position thereof, shown in FIG. 2. Now fresh fluid can flow into the chamber 8 from the storage container. The floating body then rises in step with the flowing of the fluid into the metering chamber and when said chamber 8 is filled with fluid, the floating body has reached the operative position thereof shown in FIG. 1, where it seals off the communication between the metering chamber 8 and the storage container.

The device is then in its initial position shown in FIG. 1 and ready for new dispensing operations.

Thus, the function of the structure is very simple. The diameter of the floating body is only slightly less than the inner diameter 13 of the tube 13, which results in the space 27 being relatively narrow. This results in two advantages. Primarily, the pressure which the fluid may exert in the idle position upon the self-closing closure is reduced and, secondly, the maximal deformation of the wall 13 is limited to a preselected value, which is of importance for the proper function of the self-closing closure as it has been shown that the attachment of the diaphragm is of the greatest importance for the operation of the self-closing closure. It is a very thin-walled and resilient member and the slightest irregularity in the shape or tension results in risks for a less efficient operation of the self-closing closure. In case the wall 13 should be permitted to be deformed without limits, this would result in such tensions in the portion of the device to which the diaphragm is attached, that the operation would be hazardous but, also the tube would thereby lose the capacity of returning to the initial shape thereof. However, by the limited deformation according to the present invention, such a risk is eliminated.

What is claimed is:

1. A device for dispensing fluid from a container, said device comprising a vertically oriented metering chamber including a flexible tube forming at least a portion of the side walls of the chamber, the tube having the interior thereof in communication with said container through an inlet in the upper end of the chamber, said inlet forming a valve seat through which fluid can flow from said container into said metering chamber, an elongated floating member housed in said chamber, said member acting as a valve for opening and closing said inlet under pressure of the level of fluid in said metering chamber, said metering chamber also having an outlet in its lower end for dispensing liquid, and a self-closing closure in said outlet for opening said outlet under a predetermined pressure upon the fluid in said metering chamber, said floating member being dimensioned with respect to said tube for permitting fluid to rise between the sides of the floating member and the inside of said tube for determining the amount of fluid to be dispensed upon squeezing the tube inwardly against the sides of the floating member, the larger the area of the tube squeezed against the floating member the larger the amount of fluid dispensed in a single squeezing action.

2. A device as claimed in claim 1 wherein said flexible tube and the floating member are substantially right circular cylinders and the floating member is substantially rigid, the upper end of the floating member being shaped as a valve cone to sealing contact said valve seat.

3. A device as claimed in claim 1, wherein said floating member has a relatively large volume such that it considerably reduces the pressure exerted upon the self-closing closure by the fluid in said metering chamber as well as the maximum compression of said metering chamber during the dispensing operation.

4. A device as claimed in claim 1, wherein said floating member is hollow and preferably closed by means of a plug or a similar means.

5. A device as claimed in claim 1, wherein said floating member is made from a material having a relatively low density compared to the density of the fluid.

6. A device as claimed in claim 1, wherein said metering chamber has a thickened portion in the upper end thereof, the end surface thereof having an annular, relatively deep groove, provided with a circumferential recess in the wall surrounding said groove.

7. A device as claimed in claim 1, wherein said self-closing closure comprises a diaphragm provided with an outlet opening and an annular member sealing connected to said diaphragm along the outer edge portion thereof, which annular member has a pin to sealingly engage the opening of the diaphragm the outer edge portion of the closure being connected to said metering chamber.

8. A device as claimed in claim 1 wherein said metering chamber is calibrated such that said flexible tube may be encompassed by a hand and pressed against said floating member which thereby limits the compression of said flexible tube.

* * * * *